US007217137B1

(12) United States Patent
Nakagawa

(10) Patent No.: US 7,217,137 B1
(45) Date of Patent: May 15, 2007

(54) COAXIAL CONNECTOR HAVING A SWITCH

(75) Inventor: Tsuyoshi Nakagawa, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/591,572

(22) Filed: Nov. 2, 2006

(30) Foreign Application Priority Data

Nov. 18, 2005 (JP) ..... 2005-334135

(51) Int. Cl.
*H01R 12/00* (2006.01)

(52) U.S. Cl. ..... 439/63; 439/188; 439/521

(58) Field of Classification Search ..... 439/63, 439/188, 247, 289, 578, 824, 135, 521
See application file for complete search history.

(56) References Cited

U.S. PATENT DOCUMENTS 6,296,492 B1 * 10/2001 Fujimoto et al. ..... 439/63
7,114,957 B2 * 10/2006 Duquerroy et al. ..... 439/63
7,118,383 B2 * 10/2006 Nagata et al. ..... 439/63
D535,619 S * 1/2007 Nagata ..... D13/133
7,165,974 B2 * 1/2007 Kooiman ..... 439/63

FOREIGN PATENT DOCUMENTS

JP 2003-123915 4/2003

* cited by examiner

*Primary Examiner*—Khiem Nguyen
(74) *Attorney, Agent, or Firm*—Takeuchi & Kubotera, LLP

(57) ABSTRACT

The coaxial connector having a switch, which is mounted on a board, according to the invention includes an insulated housing having a hole that can receive a center conductor of a coaxial plug from the upper side, an outer conductor that is provided outside of the insulated housing and can be attached to/detached from an outer conductor of the coaxial plug, and a stationary terminal and a movable terminal, which are provided below the hole and can contact to/be away from each other. The stationary terminal has a contact section and the movable terminal has a securing section secured in the insulated housing and an elastic section that is arranged in the insulated housing through a insert hole provided in the insulated housing, extends like a cantilever from the securing section, can touch the center conductor of the coaxial plug and can contact with the contact section. In addition, the coaxial connector further includes a covering section to cover the insert hole.

20 Claims, 9 Drawing Sheets

COAXIAL CONNECTOR HAVING A SWITCH

BACKGROUND OF THE INVENTION

The present invention relates to a coaxial connector for mounting on a circuit board, especially a coaxial connector having a switch, which has a switching mechanism to switch a high-frequency signal circuit.

In a portable communication device, such as a cellular phone, a coaxial connector having a switch is widely used for checking a high-frequency circuit. As a conventional coaxial connector having a switch, for example, the applicant of this patent application disclosed in Unexamined Japanese Patent Application Publication No. 2003-123915.

The conventional coaxial connector 21A disclosed in the aforementioned patent publication is illustrated in FIGS. 21–23. FIG. 21 is a vertical cross-sectional view taken along the center line of the conventional connector 21A, which is illustrated with a coaxial plug that can be used for turning on/off the switch, FIG. 22 is a front perspective view of the conventional connector 21A, and FIG. 23 is a backside perspective view of the conventional connector 21A.

As shown in FIG. 21, the coaxial plug 26A can be attached/detached to/from the conventional connector 21A from the upper side of the connector 21A. The coaxial plug 26A includes an insulated housing 27A having a generally cylindrical shape, an outer conductor 28A that covers the insulated housing 27A, and center conductor 29A, which is provided along the center axis of the insulated housing 27A. The outer conductor 28A and the center conductor 29A protrude below the insulated housing 27A, and can be elastically displaced upward.

On the other hand, the conventional connector 21A includes an insulated housing 22A having a hole 35A to receive the center conductor 29A of the coaxial plug 26A, an outer conductor 23A provided outside of the insulated housing 22A, a stationary terminal 24A and a movable terminal 25A, which are provided below the hole 35A. Furthermore, the stationary terminal 24A has a contact section 40A, and the movable terminal 25A has a securing section 42A secured to the insulated housing 22A and an elastic section 44A that can touch the center conductor 29A of the coaxial plug 26A and can contact with the contact section 40A.

In this conventional connector 21A, when the coaxial plug 26A is not attached as shown in the solid line in FIG. 21A, the movable terminal 25A presses the contact section 41A of the stationary terminal 24A by an elastic force of the elastic section 44A, and the stationary terminal 24A and the movable terminal 25A maintain the electrical connection.

On the other hand, in the conventional connector 21A, when the coaxial plug 26A is attached as shown with the imaginary line (the dashed-two dotted line) in FIG. 21, the lower edge 33A of the outer conductor 28A fits into the annular groove 32A of the outer conductor 23A, and the lower end of the center conductor 29A is inserted to the vertical hole 35A. At this time, if the coaxial plug 26A is pressed down, the outer conductor 28A is compressed against the elastic force, and the center conductor 29A protrudes below the outer conductor 28A, and contacts with the elastic section 44A at a specified contacting position. At this time, since the elastic force of the center conductor 29A is stronger than that of the elastic section 44A, as shown with the imaginary line in FIG. 21, the elastic section 44A is pressed down by the center conductor 29A and elastically deformed, and moves away from the contact section 40A. The stationary terminal 24A and the movable terminal 25A are electrically disconnected, and at the same time, the center conductor 29A and the movable terminal 25A are connected. Accordingly, the high-frequency circuit can be checked by transmitting the signals, which are originally transmitted from the movable terminal 25A to the stationary terminal 24, from the movable terminal 25A to the center conductor 29A.

In the above-described conventional connector 21, even after the movable terminal 25A and the stationary terminal 24 are mounted in the insulated housing 22A, since the hole 51A to insert the movable terminal 25A, especially its elastic section 44A, into the insulated housing 22A and the hole 80A to insert the stationary terminal 24A to the insulated housing 22A are kept open, an alien substance can get in the product therefrom, and may adversely affect the contact between the signal terminals.

SUMMARY OF THE INVENTION

In view of the problems in the conventional technique, it is an object of the invention to provide a coaxial connector having a covering structure to reduce the entry of an alien substance in the product.

The invention relates to a coaxial connector having a switch, which is mounted on a circuit board, and is comprised of an insulated housing having a hole to accept a center conductor of the coaxial plug from the upper side, an outer conductor that can be attached to/detached from the outer conductor of the coaxial plug, a stationary terminal and a movable terminal, which are provided below the hole and can contact to/move away from each other. The stationary terminal has a contact section, and the movable terminal has a securing section to secure the movable terminal to the insulated housing, and an elastic section, which is provided inside the insulated housing through a insert hole provided in the insulated housing, extends from the securing section like a cantilever, can touch the center conductor of the coaxial plug, and can contact with the contacting section. The coaxial connector has a covering section to cover the insert hole. When the center conductor of the coaxial plug is fitted into the hole of the insulated housing, the center conductor touches the elastic section, and the elastic section moves way from the contact section.

In the above-described connector, the covering section can be integrally formed as a part of the insulated housing. In the above connector, the covering section is formed by extending a part of the insulated housing so as to cover the insert hole and can be bent toward the insert hole to cover the insert hole.

In the above-described connector, a cut can be provided on the surface of the insulated housing on the side opposite to the bending side so as to easily bend the covering section.

In the above-described connector, the covering section can be formed so as to touch the protrusion, which protrudes from the insulated housing outside of the insert hole, when it covers the insert hole.

In the above connector, the outer conductor of the coaxial connector can have a pressing section to position and secure the covering section.

In the above connector, the pressing section can be formed by extending a part of the outer conductor along the covering section at the inserting side of the moveable terminal, and can be bent toward the insert hole.

In the above-described connector, a cut can be provided on the surface of the outer conductor on the same side as the bending side so as to easily bend to form the pressing section.

In addition, in the above connector, the pressing section can have a narrow section, where a cut was formed.

Moreover, in the above connector, the width of the pressing section in the direction horizontal to the bending direction of the pressing section is preferably smaller than that of the covering section in the direction horizontal to the bending direction of the covering section.

The invention is a coaxial connector having a switch, which mounted on a circuit board, and is comprised of an insulated housing having a hole to accept a center conductor of the coaxial plug from the upper side, an outer conductor that can be attached to/detached from the outer conductor of the coaxial plug, a stationary terminal and a movable terminal, which are provided below the hole and can contact with/move away from each other. The stationary terminal has a contact section, and the movable terminal has a securing section to secure the stationary terminal to the insulated housing, and an elastic section, which is arranged inside the insulated housing through a insert hole of the insulated housing, extends from the securing section like a cantilever, can touch the center conductor of the coaxial plug, and can contact with the contacting section. The coaxial connector has a covering section to cover the insert hole. When the center conductor of the coaxial plug is fitted into the hole of the insulated housing, the center conductor touches the elastic section, and the elastic section moves way from the contact section.

In the above connector, two side protrusions that protrude from the insulated housing can be provided so that a part of the stationary terminal is interposed between those side protrusions.

In addition, in the above connector, the contact section of the stationary terminal can have an isosceles triangle shape for the cross-section in the above-described inserting direction, and the side protrusions can protrude so as to be across near the two vertexes of the base of the isosceles triangle.

In addition, in the above connector, the side protrusions can be integrally formed as a part of the insulated housing.

According to the invention, entry of alien substances inside the product can be prevented easily by a simple structure.

DESCRIPTION OF THE PREFERRED EMBODIMENTS

An embodiment of the coaxial connector having a switch according to the invention will now be described with reference to the accompanying drawings.

Figure 21:
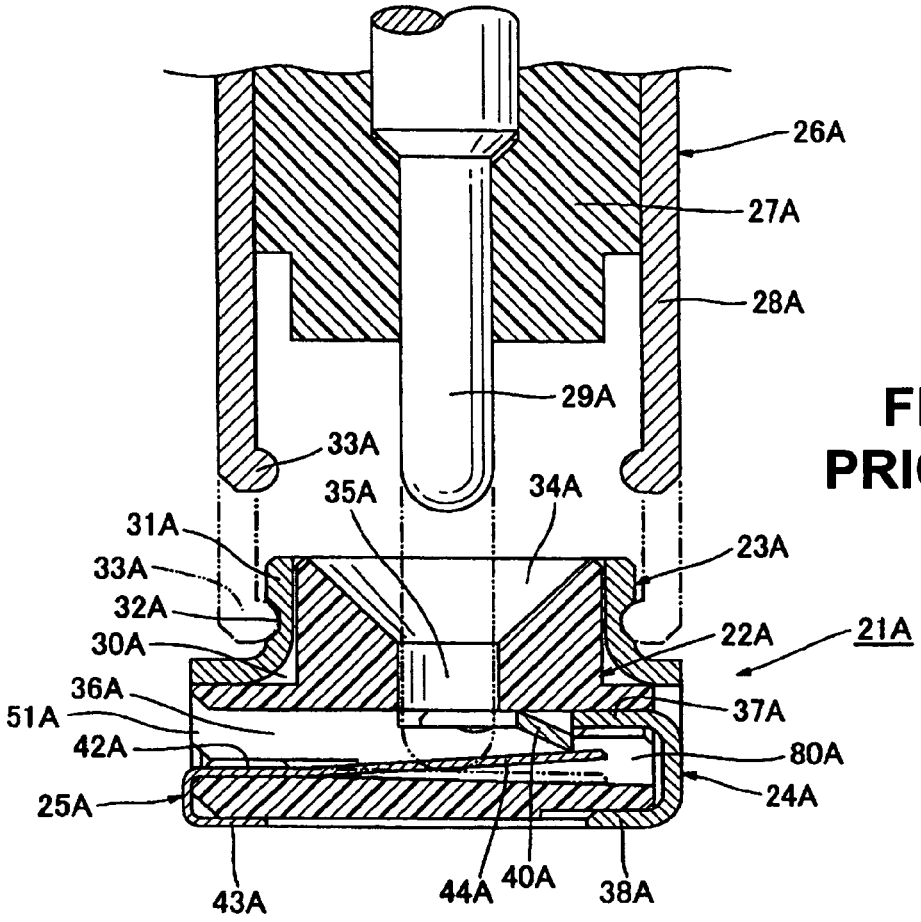
FIG. 21 PRIOR ART
FIG. 21 is a vertical cross-sectional view taken along the center line of the conventional connector, illustrated with a coaxial plug that can be used for turning on/off a switch.
Figure 22:
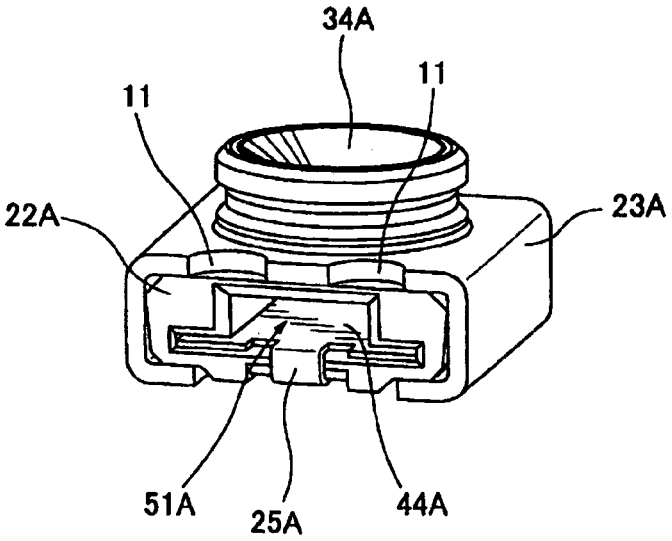
FIG. 22 PRIOR ART
FIG. 22 is a front perspective view of the conventional connector.
Figure 23:
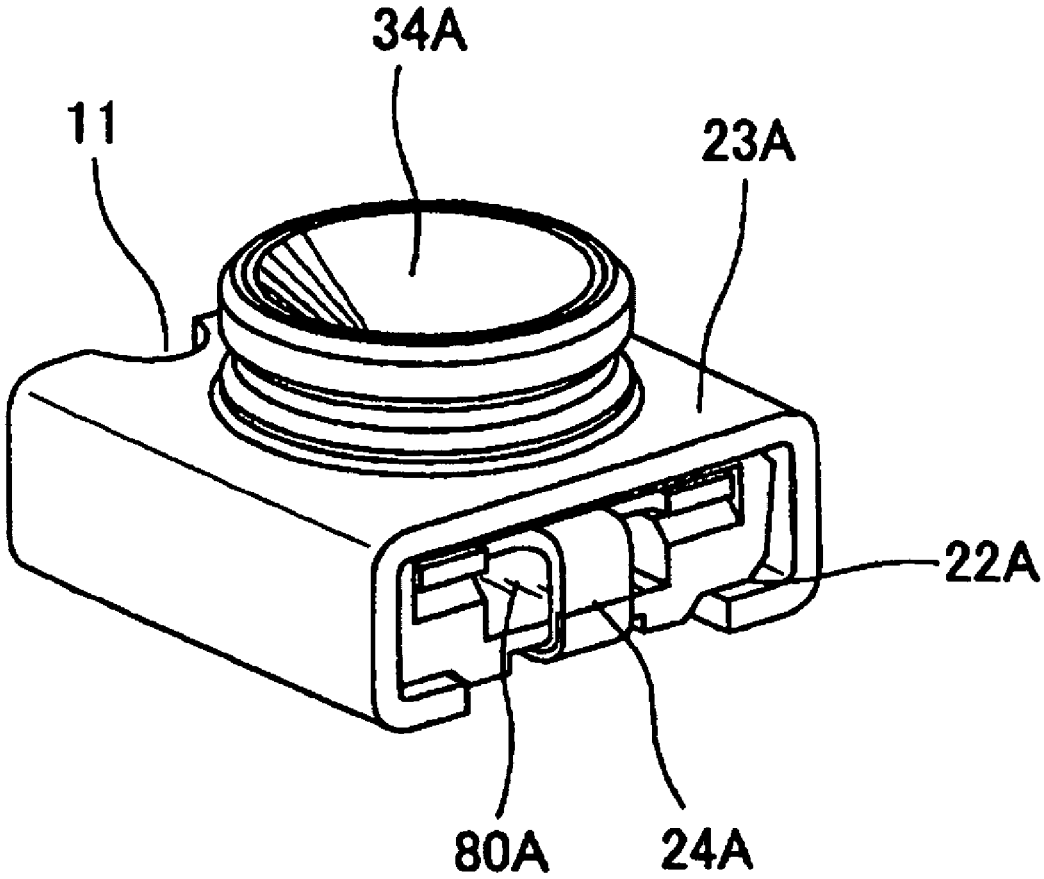
FIG. 23 PRIOR ART
FIG. 23 is a backside perspective view of the conventional connector.

A basic structure of the coaxial connector 21 is similar to that of the conventional coaxial illustrated in FIGS. 21–23. The coaxial connector 21 of the invention, however, has a covering structure to prevent entry of alien substances, which is significantly different from the conventional connector 21A.

Figure 1:
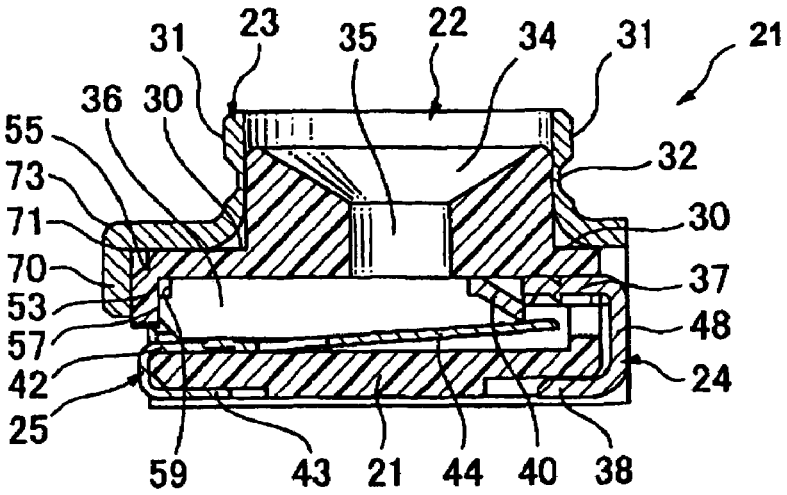
FIG. 1 is a cross-sectional view of the coaxial connector according to the invention, taken along the center line.
Figure 2:
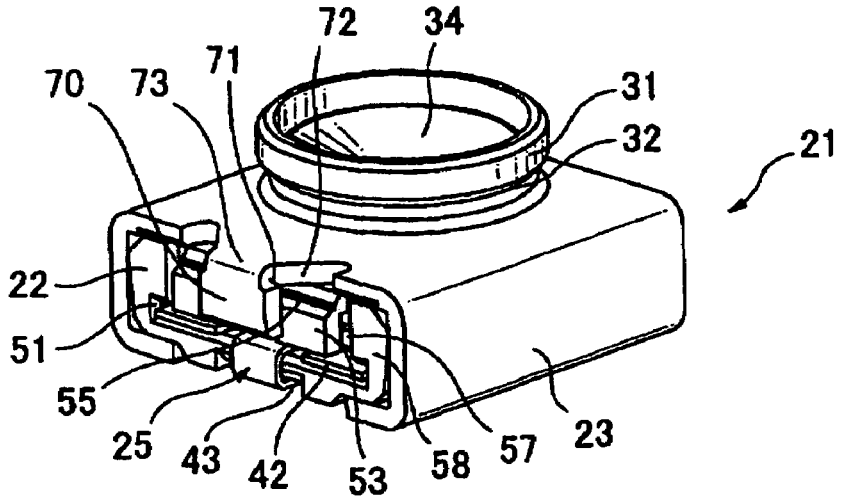
FIG. 2 is a front perspective view of the coaxial connector of FIG. 1.
Figure 3:
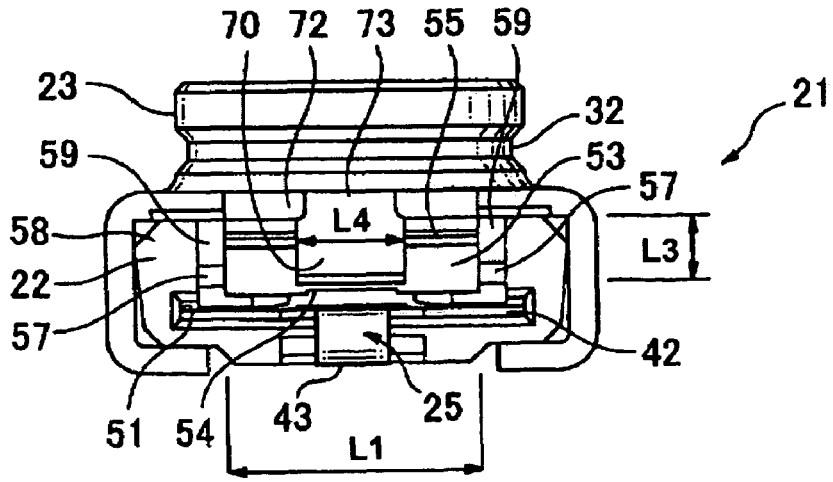
FIG. 3 is a front view of the coaxial connector of FIG. 1.
Figure 4:
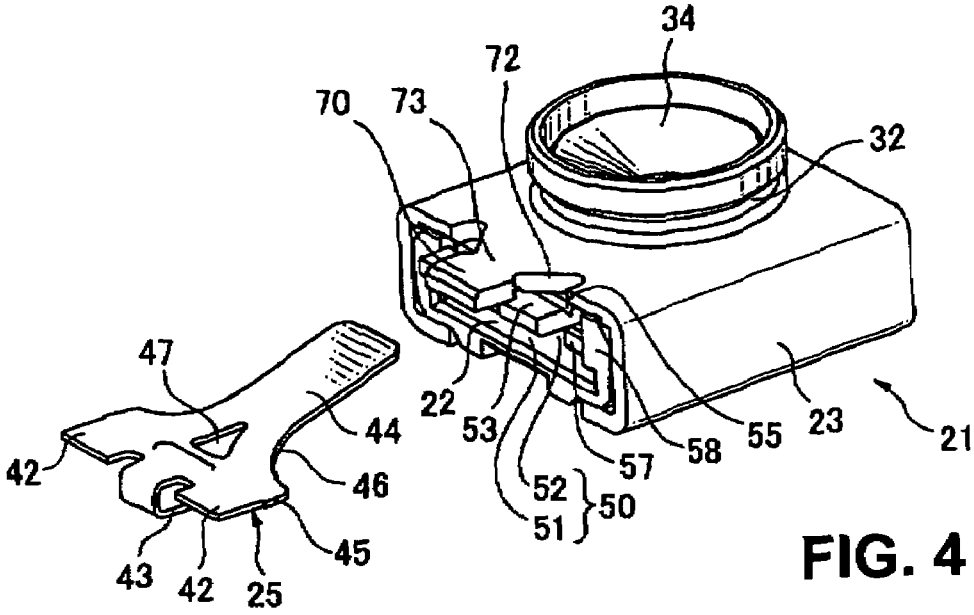
FIG. 4 is a perspective view of the insulated housing before a movable terminal is mounted therein.
Figure 5:
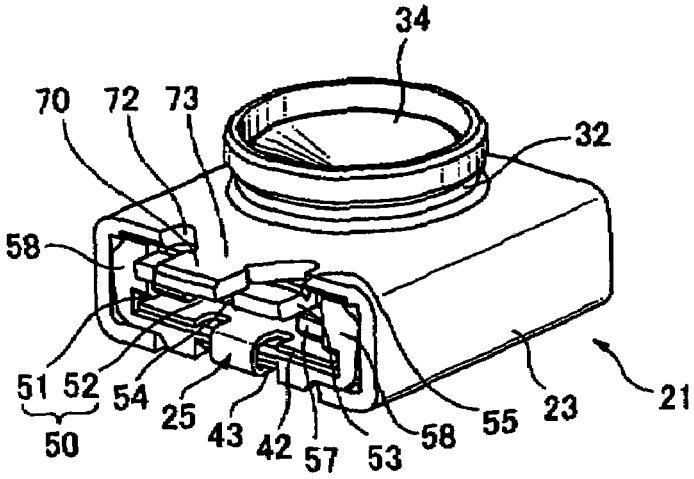
FIG. 5 is a perspective view of the insulated housing right after the movable terminal is mounted therein.
Figure 6:
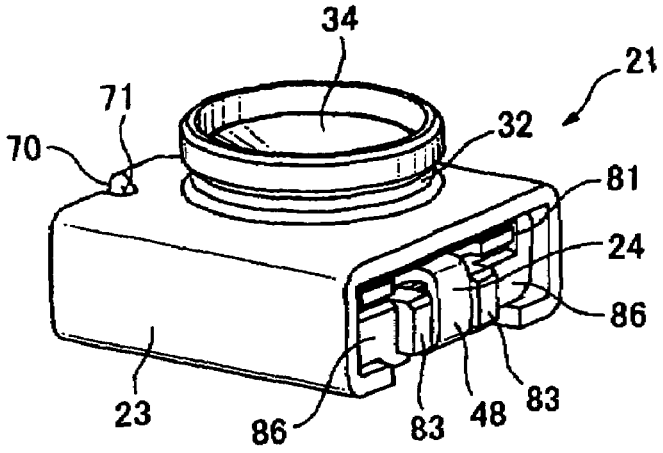
FIG. 6 is a backside perspective view of the coaxial connector illustrated in FIG. 1.
Figure 7:
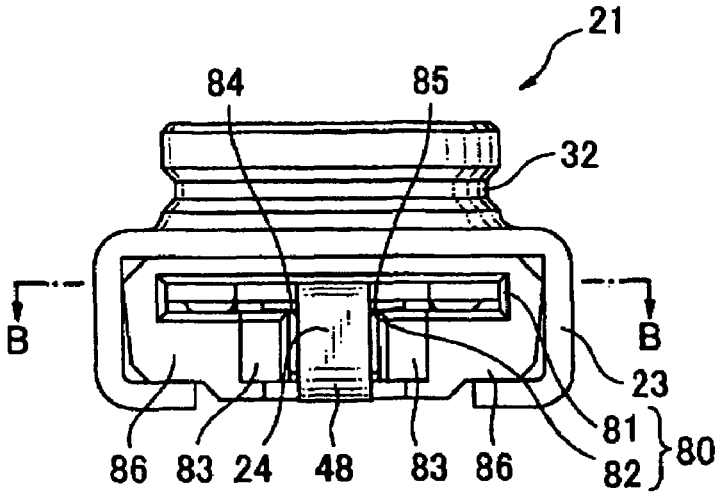
FIG. 7 is a backside view of the coaxial connector illustrated in FIG. 1.
Figure 8:
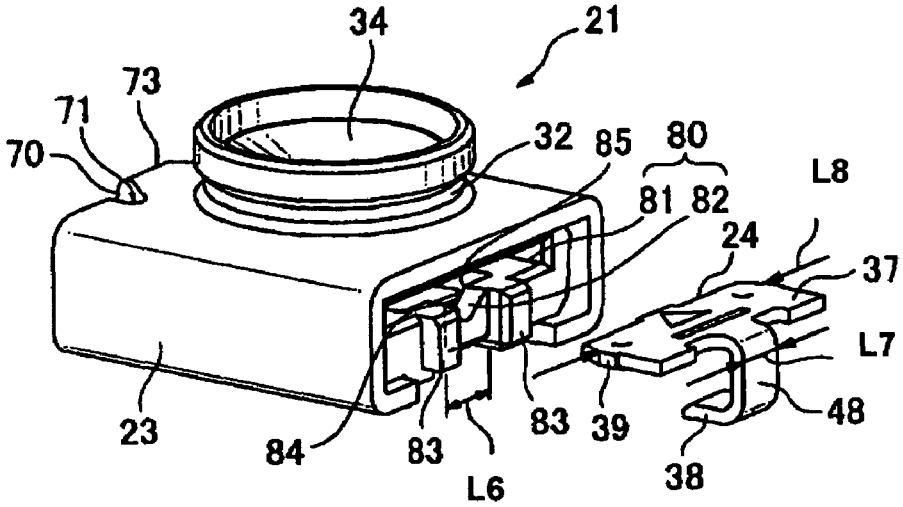
FIG. 8 is a perspective view of the insulated housing before the stationary terminal is mounted therein.
Figure 9:
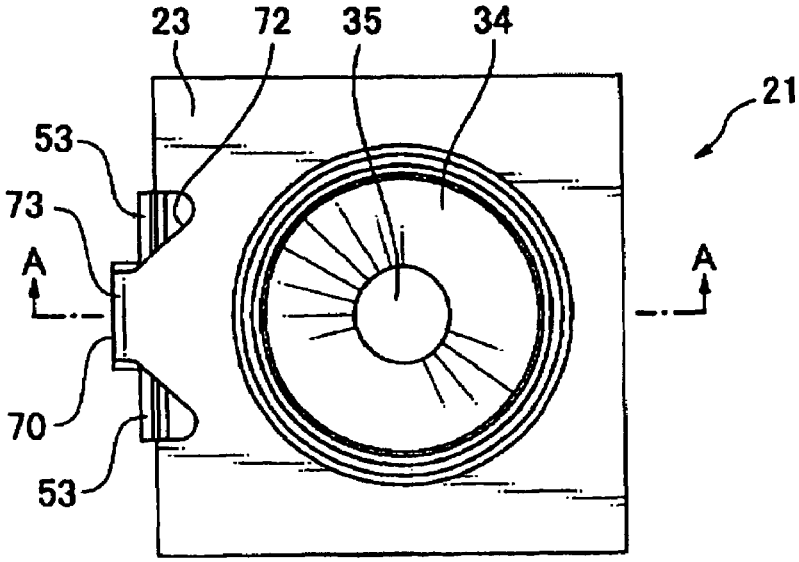
FIG. 9 is a top view of the coaxial connector illustrated in FIG. 1.
Figure 10:
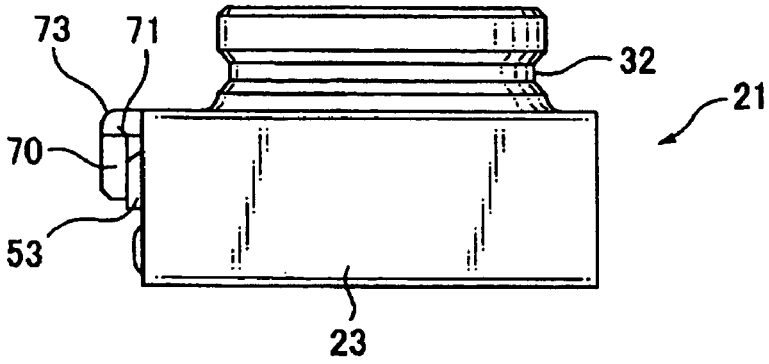
FIG. 10 is a side view of the coaxial connector illustrated in FIG. 1.
Figure 11:
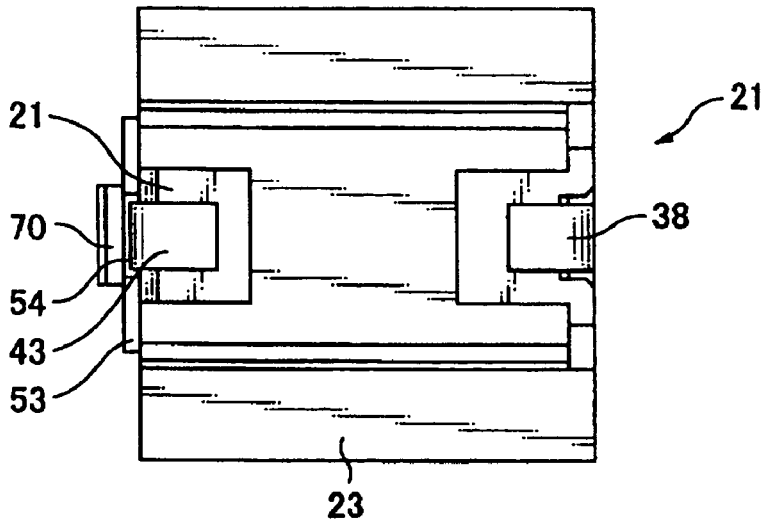
FIG. 11 is a backside view of the coaxial connector of FIG. 1.
Figure 12:
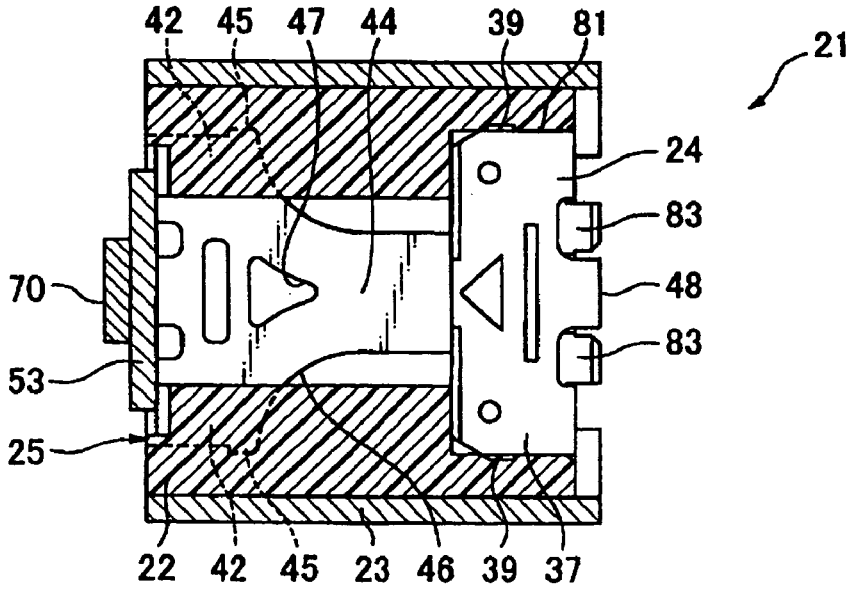
FIG. 12 is a cross-sectional view taken along line B—B of FIG. 7.

The whole view of the coaxial connector 21 of the invention is shown in FIGS. 1–12. In those figures, the members that correspond to those of the conventional connector 21A in FIGS. 21–23 are denoted by deleting "A" from the reference numerals in FIGS. 21–23. FIGS. 21–23 correspond to FIGS. 1, 2 and 6, which illustrate the invention. More specifically, FIG. 1 is a cross-sectional view of the coaxial connector according to the invention, taken along the center line (cross-sectional view, taken along line A—A of FIG. 9). FIG. 2 is the front perspective view; FIG. 3 is the front view; FIG. 4 illustrates the insulated housing 22 before the movable terminal 25 is mounted therein; FIG. 5 illustrates the insulated housing right after the movable terminal 25 is mounted therein; FIG. 6 is the backside perspective view of the coaxial connector according to the invention; FIG. 7 is the backside view; FIG. 8 shows the insulated housing before the stationary terminal is mounted therein; FIGS. 9–11 are the top view, side view, and backside view of the coaxial connector of the invention, respectively; and FIG. 12 is a cross-sectional view taken along line B—B of FIG. 7.

Figure 13:
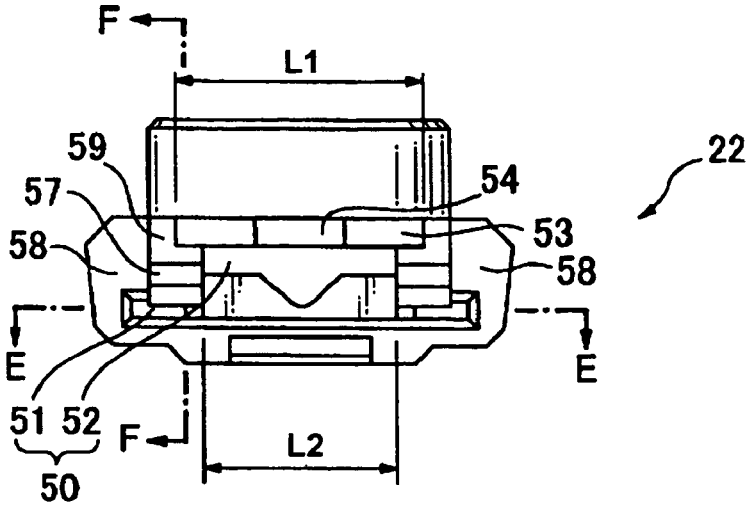
FIG. 13 is a front view of the insulated housing.
Figure 14:
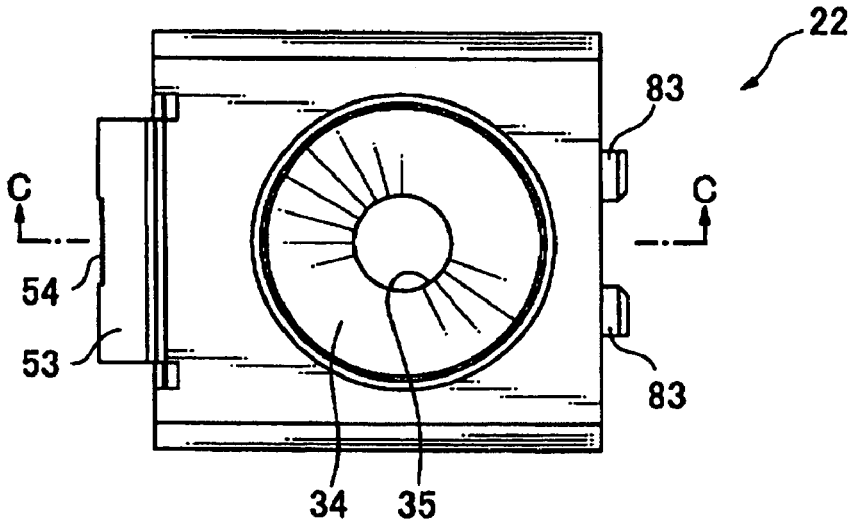
FIG. 14 is a top view of the insulated housing of FIG. 13.
Figure 15:
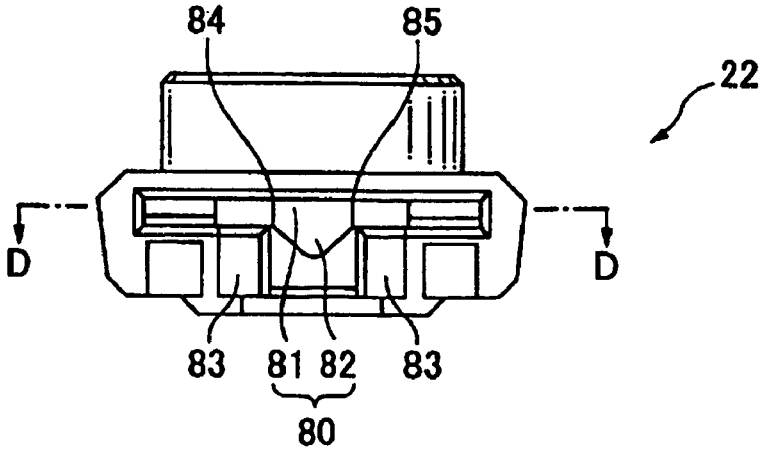
FIG. 15 is a backside view of the insulated housing of FIG. 13.
Figure 16:
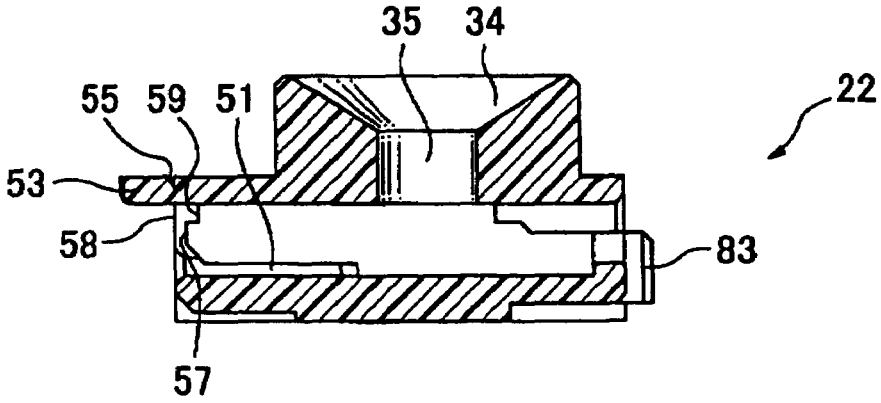
FIG. 16 is a cross-sectional view taken along line C—C of FIG. 14.
Figure 17:
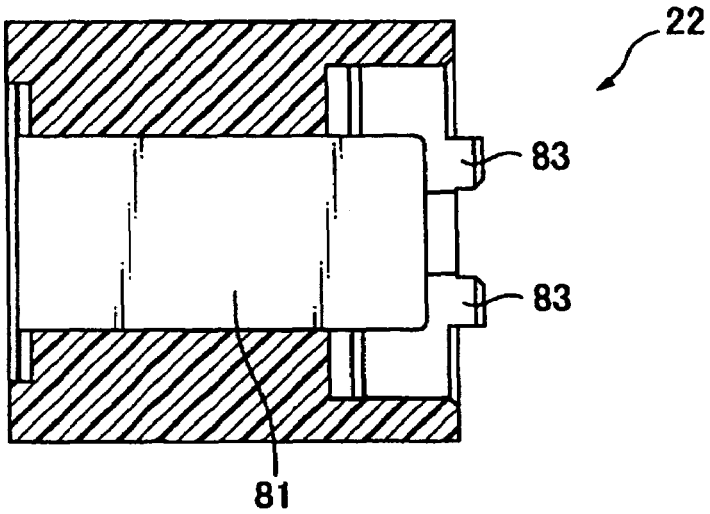
FIG. 17 is a cross-sectional view taken along line D—D of FIG. 15.
Figure 18:
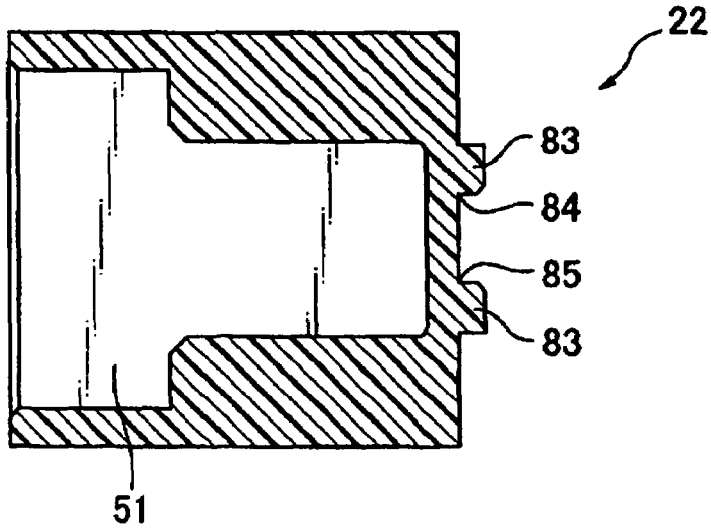
FIG. 18 is a cross-sectional view taken along line E—E of FIG. 13.
Figure 19:
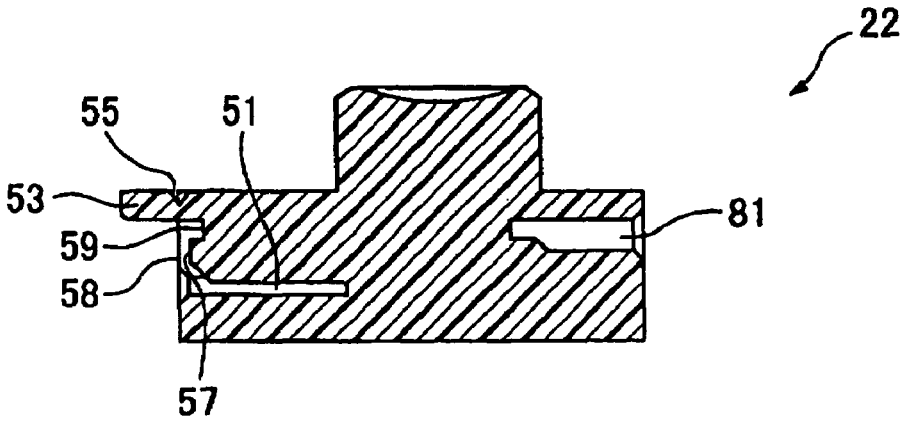
FIG. 19 is a cross-sectional view taken along line F—F of FIG. 13.
Figure 20:
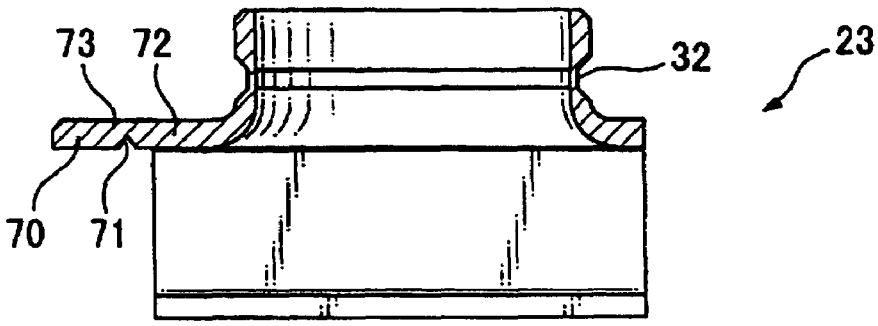
FIG. 20 is a sectional view of an outer conductor.

FIGS. 13–19 show individual component, especially the insulated housing of the coaxial connector illustrated in FIGS. 1–12. FIG. 20 shows the individual component, especially the outer conductor 23 of the coaxial connector 21. More specifically, FIGS. 13–15 are the front view, the top view, and the backside view of the insulated housing 22, respectively, and FIG. 16 is a cross-sectional view taken along line C—C of FIG. 14. FIG. 17 is a cross-sectional view taken along line D—D of FIG. 15; FIG. 18 is a cross-sectional view taken along line E—E of FIG. 13; and FIG. 19 is a cross-sectional view taken along a line F—F of FIG. 13.

As fully shown in FIG. 1, the coaxial connector 21 having a switch according to the invention includes the insulated housing 22 that has generally rectangular parallelepiped shape and is made of a resin, such as plastic, the outer conductor 23 that is provided outside of the insulated housing 22 and is made of metal, and the stationary terminal 24 and the movable terminal 25, at least a part of which is arranged in the insulated housing. The coaxial connector 21 can be mounted on a circuit board (not illustrated), and can form a part of a circuit board being connected to the circuit board via a board-connecting section 38 (fully illustrated in FIG. 11) of the stationary terminal 24 or via a board-connecting section 35 of the movable terminal 25, which are exposed outside.

An annular projecting rim 30 is provided along the outer circumference of the upper portion of the insulated housing 22. An upper section 31 of the outer conductor 23 is provided being bent so as to cover the projecting rim 30. An annular groove 32, which has a semi-circular cross-section, is formed on the outer circumferential surface of the upper portion 31 of the outer conductor 23, and the annular groove 32 can fit to the lower edge section 33 (see FIG. 21) of the outer conductor 28 of the coaxial plug 26. In addition, a conical opening 34 is formed on the upper side of the insulated housing 22, and is concentrically connected to a vertical hole 35 on the bottom of the opening 34. In addition, horizontally long space 36 connected to the vertical hole 35 is formed under the vertical hole 35, and once the coaxial plug 26 is fitted, the lower end of the center conductor 29 is inserted through the vertical hole 35 and reach the space 36.

As fully shown in FIG. 4, the movable terminal 25 has a flat securing section 42, the board-connecting section 43 which is bent downward at the base of the securing section 42 to form a U-shape, and has an elastic section 44 that obliquely extends upward like a cantilever from the securing section 42. The elastic section 44 can touch the center conductor 29 (see FIG. 21), and can contact with the lower edge of the contact section 40 at a position closer to the end of the elastic section than where the elastic section 44 touches the center conductor 29. A wedge-shaped protrusion 45 is formed on each side portion of the securing section 42, and the securing section 42 is horizontally pressed into the space 36 through the insert hole 50 of the insulated housing 22 from the side opposite to the side to pressing the stationary terminal 24. The elastic section 44 becomes wider toward the securing section 42 of the movable terminal 25 if it is viewed from the touching position with the center conductor 29, and its side edges 46 there are curved inward. Moreover, the elastic section 44 has a cutout section at a position closer to the securing section than the touching position, and this cutout section 47 extends along the elastic section 44, and preferably has a generally triangle shape along the shape of the side edges 46.

As fully shown in FIG. 8, the stationary terminal 24 has a flat securing section 37, a board-connecting section 38 provided at the edge being bent downward so as to form a square-bottomed U-shape, and an arm 48, and is formed so as not to prevent the movement of the center conductor 29 in the axial direction. Here, the width $L_8$ of the securing section 37 in its width direction is set much larger than the width $L_7$ of the arm 48. A wedge-shaped protrusion 39 is formed on the sides of the securing section 37. The securing section 37 is horizontally pressed into the space 36 via the protrusions 39 through the insert hole 80 of the insulated housing from the side of the insulated housing 22. As a result, while the securing section 37 is disposed in the insulated housing 22, the other sections, arm 48 and the board-connecting section 38, are left exposed to the outside of the insulated housing 22. In addition, a contact section 40 (see FIG. 1) protruding downward is provided at almost center portion of the securing section. This contact section 40 is formed by pushing and bending downward after making a cut along the base of the isosceles triangle, so as to precisely determine the position to contact with the elastic section 44. The contact section 40 has an isosceles triangle shape for the cross-section in the horizontal inserting direction.

As fully shown in FIGS. 1–4, 16 and 19, a part of the side edge of the insulated housing on the side of inserting the movable terminal 25 extends so as to cover the insert hole 50 on the side of inserting the movable terminal 25. This extending section 53 can be bent toward the insert hole 50 (i.e., downward) from the straight position so as to cover the insert hole 50. In other words, the extending section 53 can be used as a covering section to cover the insert hole 50. The insert hole 50 has two insert hole sections; a first insert hole section 51 that is relatively small but has a larger width corresponding to the securing section 42 of the movable terminal 25 but does not have a large height; and a second insert hole section 52, which is relatively large but has narrow width corresponding to the elastic section 44 of the movable terminal 25 but has large height. Here, the insert hole section that needs to be covered with the covering section 53 is only the second insert hole section 52. The first insert hole section 51 is almost completely covered when the securing section 42 of the movable terminal 25 is pressed therein. The covering section 53 preferably has a generally wide rectangular shape, corresponding to the shape of the second insert hole 52. As shown in FIGS. 13 and 3, the width $L_1$ of the covering section 53 in the lateral (or the width) direction, i.e. the direction horizontal to the bending direction, is larger than the width $L_2$ of the second insert hole section 52, and as shown in FIG. 3, the height $L_3$ of the covering section in the longitudinal direction (the direction vertical to the bending direction) at the time of bending is as large as it reach the upper edge of the securing section 42 of the movable terminal 25. As a result, the second insert hole section can be almost completely covered by the covering section 53.

The covering section 53 can be integrally formed as a part of the insulated housing 22. In order to easily bend the covering section 53, V-shaped cut 55 is provided in the lateral direction at a specified position on the insulated housing surface opposite to the bending side. In order to easily bend, a specified length of a cut groove 54 can be provided near the center of the edge of the covering section 53. When the covering section 53 is bent and covers the second insert hole section 52, the covering section 53 can touch the projecting section 57 of the insulated housing 22 at its inside, i.e. the side that is bent. This projecting section 57 is a section that protrudes from the insulated housing 22 up to a position between the outermost wall 58, which protrudes most outward from the insulated housing wall on the side of the insert hole 50 and the innermost wall 59 that is receded most. Once the covering section 53 touches the projecting section 57, the incompleteness caused by the cut 55 of the covering section 53 can be solved and the insert hole 50 can be more surely covered.

Corresponding to the covering section 53, a part of the side edge of the outer conductor 23 extends on the side of inserting the movable terminal 25 along the covering section 53. This extending section 70 can be bent toward the insert hole (i.e. downward) so as to cover a part of the upper part of the covering section 53. In other words, this extending section 70 can be used as a pressing section 70 to position and secure the covering section 53. The shape of the pressing section 70 is not specifically limited, but for example, it can be generally rectangular shape having a narrow width as in the figure. As shown in FIG. 3, the width $L_4$ of the pressing section 70 in the lateral or the width direction (the horizontal direction to the bending direction) is set smaller than the width $L_1$ of the covering section 53 in the direction. Even by setting the width in this way, since the outer conductor 23 is made of hard metal, the covering section is considered to work well as a pressing section. In addition, by setting the dimensions in this way, it can reduce concern of generating noise signals that can be caused when the outer conductor 23, which can also work as a ground, gets close to the movable terminal 25.

Similarly to the covering section 53, the pressing section 70 can be integrally molded as a part of the outer conductor 23. A V-shaped cut 71 is provided along the lateral direction at a specified position on a surface of the outer conductor on the same side as the bending side, so as to be able to easily bend. Here, being different from the cut 55 of the insulated housing 22 provided on the surface opposite to the bending side, the cut 71 of the pressing section 70 is provided on the same side of the surface as the bending side, so as to be able to fully exhibit the effects on the covering section 53.

At the time of forming the pressing section 70, the visual inspection groove 11 (see FIGS. 21 and 22) can be used. The visual inspection groove 11 is usually used to check the direction of the current flow on the board, but by changing the shape of the visual inspection groove, i.e. by forming a narrow section 73 tapering the width towards the cut 71 of the pressing section 70, the pressing section 70 can be easily bent at a specified position.

The pressing section 70 can be bent at the same time of bending the covering section 53 of the insulated housing 22, but can be bent after bending the covering section of the insulated housing 22. Here, if they are bent simultaneously, the work can be simplified.

As fully shown in FIGS. 6–8, the insulated housing 22 has a insert hole 80 having a shape that corresponds to the cross-section of the securing section 37 in the direction of pressing the securing section 37 on the side of pressing the securing section 37 of the stationary terminal 24. Similarly to the insert hole 50, the insert hole 80 has two insert hole sections; a first insert hole section 81 that has a large width but does not have large height corresponding to the securing section 37 of the stationary terminal 24 inserted in the insert hole 80; and a second insert hole section 82 that has a isosceles triangle shape corresponding to the contact section 40 of the stationary terminal 24. Here, the first insert hole section 81 is almost completely covered when the securing section 37 of the stationary terminal 24 is pressed therein, but the second insert hole section 82 is covered to a certain degree by the flat arm 48, which is a part of the stationary terminal 24, but will not be completely covered. In order to cover it completely, a wall surface of the insulated housing on the sides of the insert hole 80 is used in this invention. More specifically, a side protrusion 83, which protrudes to the outside of the insulated housing, is provided so as to be arranged on the both sides of the arm 48. In order to achieve the effect of preventing entry of alien substances, those side protrusions 83 are preferably provided as close as possible to the arm 48. For example, those protrusions are provided so as to extend through near two vertexes of the bottom of a isosceles triangle shape of the second insert hole section 82. Here, it is satisfactory as long as the side protrusions 83 are provided so as to cover the second insert hole section on the both sides of the arm 48. For example, as illustrated in the figure, they can be provided only as a part of the surface of the insulated housing 22, or can be provided over the whole area of the surface except the portion covered by the arm 48 (i.e. the areas of the side protrusions and the area around the protrusions 86). In addition, the side protrusions 83 can be integrally formed as a part of the insulated housing 22, but can be formed as a separate piece from the insulated housing. Here, in order to even more completely cover the hole section by the arm 48, the distance $L_6$ between the two vertexes of the bottom of the isosceles that forms the cross-section of the second insert hole section 82 is preferably set generally same as the width $L_7$ of the arm 48.

The invention can be applied to various connector devices that require prevention of entry of alien substances. Therefore, the application of the invention is not limited to coaxial connectors.

The invention claimed is:

1. A coaxial connector having a switch, which is to be mounted on a board, comprising:

an insulated housing, which has a hole that can receive a center conductor of a coaxial plug;

an outer conductor, which is provided outside of said insulated housing and can attach to/detach from the outer conductor of said coaxial plug;

a stationary terminal and a movable terminal, which are provided below said hole, and can contact to/be away from each other, wherein said stationary terminal has a contact section and said movable terminal has a securing section secured in said insulated housing and an elastic section that is arranged in said insulated housing through a insert hole provided in said insulated housing, extends like a cantilever from said securing section, and can touch the center conductor of said coaxial plug and contact with said contact section; and a covering section to cover said insert hole, wherein said center conductor touches said elastic section when the center conductor of said coaxial plug fits to said hole of said insulated housing, and then said elastic section moves away from said contact section and the signal circuit will be switched.

2. The connector according to claim 1, wherein said covering section is integrally molded as a part of said insulated housing.

3. The connector according to claim 1, wherein said covering section is formed by extending a part of said insulated housing so as to be able to cover said insert hole on the side of inserting said movable terminal, and can be bent toward said insert hole so as to cover said insert hole.

4. The connector according to claim 3, wherein said insulated housing has a cut on its surface opposite to the bending side so as to be used for bending said covering section.

5. The connector according to claim 1, wherein said covering section can touch a protrusion that protrudes on the outer surface of said insulated housing than said insert hole when said insert hole is covered.

6. The connector according to claim 1, wherein said outer conductor has a pressing section to position and secure said covering section onto said outer conductor of said coaxial connector.

7. The connector according to claim 6, wherein said pressing section is formed by extending a part of said outer conductor along said covering section at the side of inserting said movable terminal, and can be bent toward said insert hole.

8. The connector according to claim 7, wherein said outer conductor has a cut on its surface that can be used for bending said pressing section.

9. The connector according to claim 8, wherein said pressing section has a narrow portion, where said cut is provided.

10. The connector according to claim 7, wherein the width of said pressing section in the direction horizontal to the bending direction of the pressing section is smaller than the width of said covering section in the direction horizontal to the bending section of said covering section.

11. A coaxial connector having a switch for mounting on a board, comprising:

an insulated housing having a hole that can receive the center conductor of a coaxial plug form the upper side;

an outer conductor, which is provided outside of said insulated housing, and can be attached/detached to/from the outer conductor of said coaxial plug; and a stationary terminal and a movable terminal, which are provided below said hole and can contact to/move away from each other, wherein said stationary terminal has a contact section, which is arranged in said insulated housing through a insert hole provided in said insulated housing, and said movable terminal has a securing section secured in said insulted housing and an elastic section, which is secured in said insulated housing and extends like a cantilever from said securing section and can touch the center conductor of said coaxial plug and can contact with said contact section, wherein said insert hole is covered by a part of said stationary terminal exposed from the outside of insulated housing and wall surface of said insulated housing when said stationary terminal is secured in said insulated housing, said center conductor touches said elastic section when said center conductor fit to said hole of said insulated housing, and then said elastic section moves away from said contact section and the signal circuit will be switched.

12. The connector according to claim 11, wherein said insulated housing has a side protrusion protruding outside of said insulated housing at both sides of a part of stationary terminal along a part of said stationary terminal.

13. The connector according to claim 12, wherein said contact section of said stationary terminal has a isosceles triangle shape at the cross-section in said inserting direction, and said side protrusions protrude outside crossing near the two vertexes of the bottom of said isosceles triangle shape.

14. The connector according to claim 12, wherein said side protrusions are integrally molded as a part of said insulated housing.

15. The connector according to claim 2, wherein said covering section is formed by extending a part of said insulated housing so as to be able to cover said insert hole on the side of inserting said movable terminal, and can be bent toward said insert hole so as to cover said insert hole.

16. The connector according to claim 15, wherein said insulated housing has a cut on its surface opposite to the bending side so as to be used for bending said covering section.

17. The connector according to claim 2, wherein said covering section can touch a protrusion that protrudes on the outer surface of said insulated housing than said insert hole when said insert hole is covered.

18. The connector according to claim 3, wherein said covering section can touch a protrusion that protrudes on the outer surface of said insulated housing than said insert hole when said insert hole is covered.

19. The connector according to claim 4, wherein said covering section can touch a protrusion that protrudes on the outer surface of said insulated housing than said insert hole when said insert hole is covered.

20. The connector according to claim 13, wherein said side protrusions are integrally molded as a part of said insulated housing.

* * * * *